US006809612B2

(12) United States Patent
Bloom et al.

(10) Patent No.: US 6,809,612 B2
(45) Date of Patent: Oct. 26, 2004

(54) DIELECTRIC BLOCK SIGNAL FILTERS WITH COST-EFFECTIVE CONDUCTIVE COATINGS

(75) Inventors: Terry R. Bloom, Middlebury, IN (US); Mark D. Erickson, Goshen, IN (US); Ronald D. Guyer, Elkhart, IN (US); Raymond G. Blair, Albuquerque, NM (US); Jeffrey R. Jacquin, Albuquerque, NM (US); Shouliang Lai, St. Petersburg, FL (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 10/135,852

(22) Filed: Apr. 30, 2002

(65) Prior Publication Data

US 2003/0201848 A1 Oct. 30, 2003

(51) Int. Cl.[7] ..... H01P 5/12

(52) U.S. Cl. ..... 333/134; 333/202; 333/207; 333/219

(58) Field of Search ..... 333/134, 202, 333/206, 207, 219

(56) References Cited

U.S. PATENT DOCUMENTS

| | | | | |
|---|---|---|---|---|
| 4,024,031 A | | 5/1977 | Lerner | |
| 4,398,164 A | * | 8/1983 | Nishikawa et al. | 333/222 |
| 4,668,925 A | * | 5/1987 | Towatari et al. | 333/219.1 |
| 4,795,658 A | * | 1/1989 | Kano et al. | |
| 4,800,348 A | | 1/1989 | Rosar et al. | |
| 5,058,799 A | * | 10/1991 | Zsamboky | |
| 5,109,536 A | * | 4/1992 | Kommrusch | 333/134 |
| 5,234,562 A | * | 8/1993 | Uenishi et al. | 204/199 |
| 5,250,916 A | * | 10/1993 | Zakman | 333/206 |
| 5,281,326 A | * | 1/1994 | Galla | |
| 5,470,808 A | | 11/1995 | Okuyama et al. | |
| 5,700,745 A | * | 12/1997 | Okuyama et al. | 501/134 |
| 5,706,999 A | * | 1/1998 | Lim et al. | |
| 6,064,283 A | * | 5/2000 | Asada | 333/202 |
| 6,099,919 A | * | 8/2000 | Ito | |
| 6,338,804 B1 | | 1/2002 | Kurisu et al. | |

FOREIGN PATENT DOCUMENTS

| | | | |
|---|---|---|---|
| EP | 0 797 266 | 9/1997 | |
| JP | 06-196901 | 7/1994 | |
| JP | 06196901 A * | 7/1994 | H01P/1/205 |
| JP | 08-084009 | 3/1996 | |
| JP | 2002-309395 | 10/2002 | |

OTHER PUBLICATIONS

*Modern Electroplating*, 3rd Edition Copyright 1974 by John Wiley & Sons, Inc. Author, Fred Pearlstein (Revision of chapter by A. Brenner in the 1963 edition) Chapter 31, Electroless Plating, pp. 710–733.*

* cited by examiner

*Primary Examiner*—Robert Pascal
*Assistant Examiner*—Kimberly Glenn
(74) *Attorney, Agent, or Firm*—Steven Weseman; Mark Bourgeois; Mark Borgman

(57) ABSTRACT

A cost-effective communication filter is prepared by etching the surfaces of a shaped and fired ceramic core, applying an electroless nickel solution to create a nickel layer of limited thickness, electroplating the nickel plated core with a silver layer, patterning the nickel and silver plated core by removing metallization from selected surface areas and then heating the patterned filter block to bond the metal layers. The resulting filters comprise a rigid dielectric core defining a plurality of through-hole passages extending between opposing sides of the core. Present on the core is a pattern of metallized and unmetallized regions wherein the metallized regions of the pattern include an inner layer of nickel and an outer silver-containing layer.

38 Claims, 5 Drawing Sheets

DIELECTRIC BLOCK SIGNAL FILTERS WITH COST-EFFECTIVE CONDUCTIVE COATINGS

TECHNICAL FIELD

This invention relates to dielectric block filters for radio-frequency signals.

BACKGROUND

Monoblock conductively-coated dielectric filters offer several advantages over lumped component filters. The blocks are relatively easy to manufacture, rugged, and relatively compact. In the basic ceramic monoblock filter design, the resonators are formed by typically cylindrical passages, called through-holes, extending through the block from the long narrow side to the opposite long narrow side. The block is substantially plated with a conductive material (i.e. metallized) on all but one of its six (outer) sides and on the inside walls formed by the through-holes.

One of the two opposing sides containing through-hole openings is not fully metallized, but instead bears a metallization pattern designed to couple input and output signals through the series of resonators. This patterned side is conventionally labeled the top of the block, though the "top" designation may also be applied to the side opposite the surface mount contacts when referring to a filter in the board mounted orientation. In some designs, the pattern may extend to sides of the block, where input/output electrodes are formed.

The reactive coupling between adjacent resonators is affected, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and other components of the RF application device.

Although such RF signal filters have received widespread commercial acceptance since the 1980s, efforts at improvement on this basic design have continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices (e.g. handsets) and longer battery life. Combined, these trends place difficult constraints on the design of wireless components such as filters. Filter designers may not simply add more space-taking resonators or allow greater insertion loss in order to provide improved signal rejection.

Moreover, the consumer market applies constant downward pressure on the price of portable wireless communication devices, which in turn puts downward pressure on related RF components such as filters. Thus there continues to be a need for lower cost monoblock filter designs as well as methods for making lower cost filters.

A cost driver in ceramic monoblock filter manufacturing is application of the conductive outer coating. Silver-based coatings are preferred for superior conductivity, but remain a costly choice for providing filter metallization. Gold coatings are technically feasible, but cost prohibitive. Copper coatings are a poorer-performing, but a less costly, alternative to silver.

One approach to producing monoblock ceramic filters includes dipping a shaped ceramic block into a viscosity-controlled slurry of silver particles to coat the ceramic block and through-holes. The dipped block is then heated to bind the silver particles together and to adhere the silver to the surfaces of the ceramic block.

The slurry dipping processes provide a silver coating which is thinner at block edges and thicker towards surface centers. For adequate filter performance and manufacturing yield, the filter conductive coatings must be sufficiently thick on all metallized pattern regions. To ensure sufficient coverage at the block edges, the resulting filters are over-coated with silver away from the edges.

Accordingly, this invention pertains to providing monoblock silver-coated dielectric filters having a more uniform silver coating layer and therefore less costly silver waste.

SUMMARY

This invention overcomes problems of the prior art by providing a communication signal filter comprising a rigid dielectric core having at least one pair of opposing sides. The core defines a plurality of through-hole passages extending between the opposing sides. Present on the core is a pattern of metallized and unmetallized regions. The metallized regions of the pattern include an inner layer of nickel and an outer silver-containing layer on the inner layer.

A method aspect of the present invention creates a monoblock communication filter having a dielectric core selectively plated with a relatively thin conductive silver on nickel coating. For example, a core of dielectric material is provided having at least one pair of opposing sides and defining a plurality of through-hole passages extending between the opposing sides. The communication filter is then created by depositing a nickel-based layer on the core, depositing a silver-containing layer over the nickel-based layer to form a plated core, patterning the plated core by removing a portion of the nickel and silver layer to form a pattern of unmetallized areas, and thereafter heating the patterned core at a temperature sufficient to melt a portion of the nickel-based layer.

The outer surface and through-hole sidewalls of the core are preferably etched with an acid solution before nickel plating. The nickel-based layer is preferably deposited on the core by contacting the core with an electroless nickel plating solution. The silver-containing layer is preferably provided by electrolytic deposition.

In a preferred embodiment of the resulting communication filter, the silver-containing layer and the nickel layer form a diffused interface therebetween substantially coextensive with the nickel layer.

An alternate embodiment of the present invention is a duplexing communication signal filter adapted for connection to an antenna, a transmitter and a receiver for filtering an incoming signal from the antenna to the receiver and for filtering an outgoing signal from the transmitter to the antenna. The duplexing filter comprises a rigid core of dielectric material with a top surface and a bottom surface and defining a series of through-holes. Each through-hole extends from an opening on the top surface to an opening on the bottom surface. Present on the core of the duplexing filter is a surface-layer pattern of metallized and unmetallized areas. The metallized areas each have a first layer of nickel and a second silver-containing layer on the first layer. The pattern includes a relatively expansive metallized area for providing off-band signal absorption, an unmetallized area circumscribing at least one of the openings, a transmitter connection metallized area, a receiver connection metallized area, and an antenna connection metallized area positioned between the transmitter connection metallized area and the receiver connection metallized area.

There are other advantages and features of this invention which will be more readily apparent from the following detailed description of preferred embodiments of the invention, the drawings, and the appended claims.

BRIEF DESCRIPTION OF THE FIGURES

In the Figures.

DETAILED DESCRIPTION OF PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
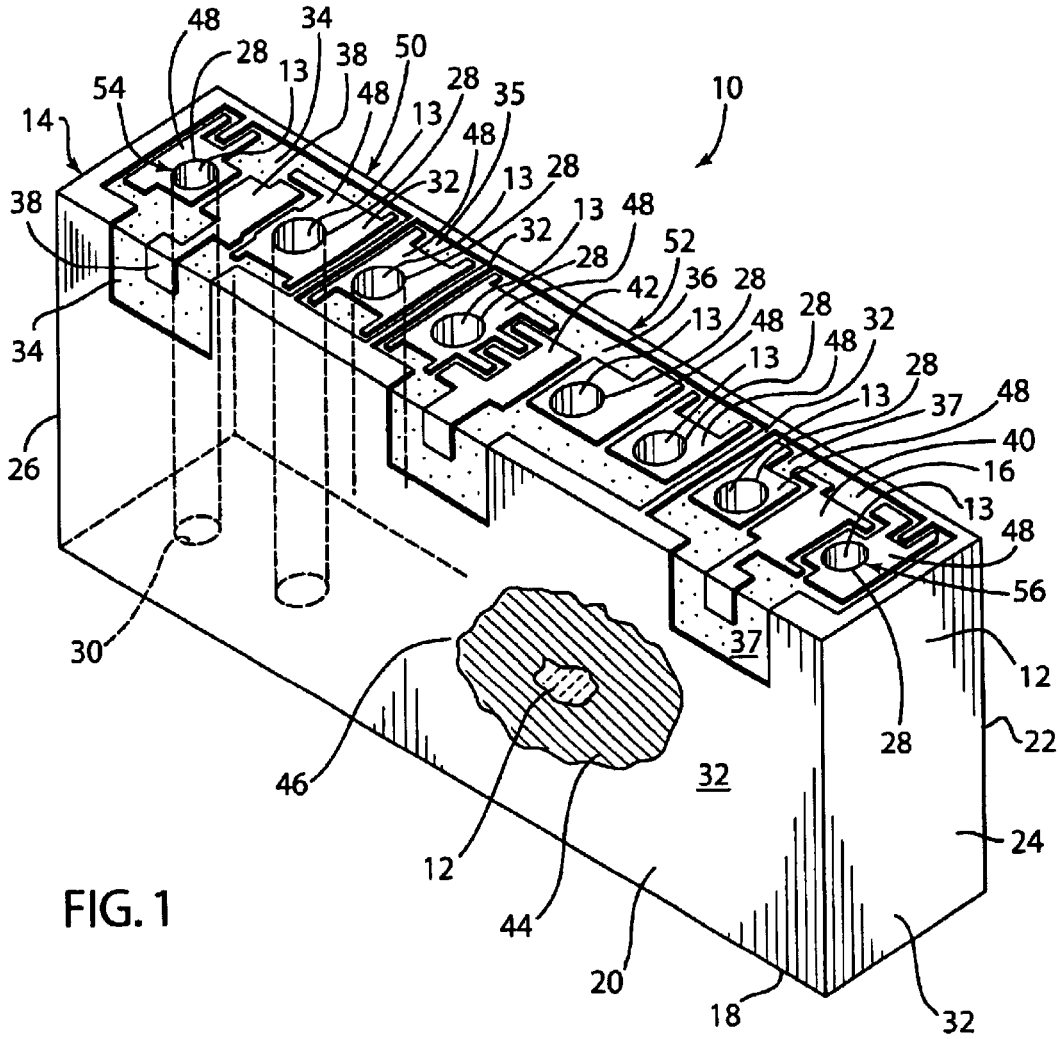
FIG. 1 is an enlarged perspective (or more precisely an isometric) view of a duplexing communication filter according to the invention.
Figure 2:
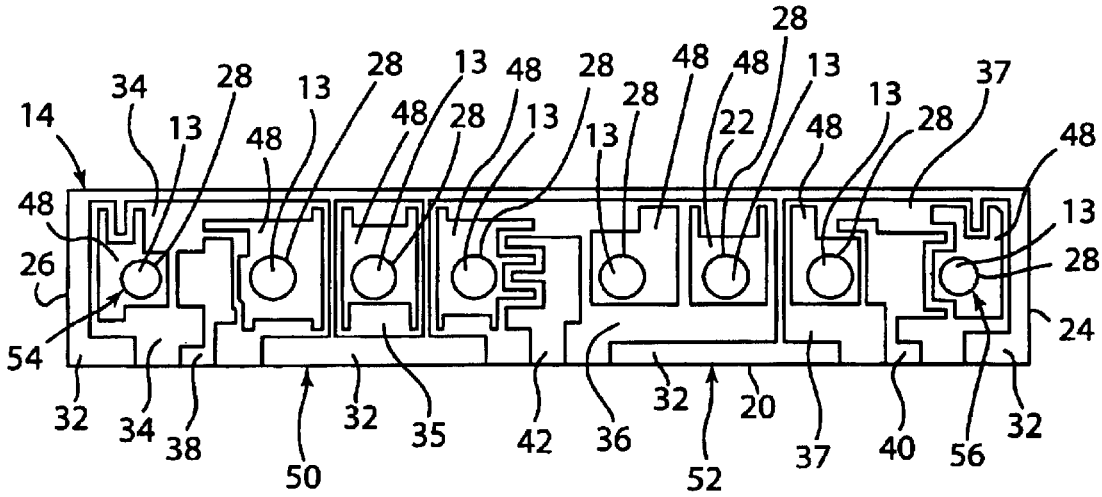
FIG. 2 is an enlarged top surface view of the filter of FIG. 1.

Referring to FIGS. 1 and 2, a duplexing communication filter 10 includes an elongate, parallelepiped (or "box-shaped") core of ceramic dielectric material 12 defining a series of through-hole passages 13 and a pattern of metallized and unmetallized areas 14. Core 12 has three sets of opposing side surfaces, a top 16 and a bottom 18, opposing long sides 20 and 22, and opposing narrow sides 24 and 26. Core 12 defines a series of through-hole passageways 13, which extend from an opening (or aperture) 28 on top side 16 to a bottom side (18) opening 30. Core 12 has approximate dimensions of about 21.3 by 9 by 4 millimeters (mm).

Pattern 14 includes an expansive, wide region of metallization 32, unmetallized regions 34, 35, 36 and 37, a transmitter metallized connection pad 38, a receiver metallized connection pad 40, and an antenna metallized connection pad 42.

Expansive metallized region 32 covers portions of top surface 16 and side surface 20, and substantially all of bottom surface 18, side surfaces 22, 24, 26 and the sidewalls of through-holes 13. Expansive metallized region 32 extends contiguously from within the through-holes 13 towards both top surface 16 and bottom surface 18. Region 32 serves as a local ground.

Each metallized region 32, 38, 40 and 42 of pattern 14 includes a first, inner layer of nickel 44 and a second, outer silver-containing layer 46. For a wide range of communication filter applications, communication filters according to the present invention have metallization regions in which the inner nickel layer 44 and the dielectric core 12 form a diffused interface therebetween substantially coextensive with the nickel layer (i.e., the nickel layer and the dielectric core have a heterogeneous interface substantially coextensive with the nickel layer.). The silver-containing layer 46 has a relatively greater thickness in the range of about 7.5 microns ($\mu$m) to about 25.4 microns ($\mu$m).

Core 12 and pattern 14 together form a series of through-hole resonators. The portions of expansive metallized region 32 extending around openings 28 of through-holes 13 are can be labeled "resonator pads." Filter 10 has eight through-holes (13) and eight corresponding resonator pads 48.

Pattern 14 includes four unmetallized regions 34, 35, 36 and 37 present on portions of top surface 16 and side surface 20.

For ease of description duplexing filter 10 can be divided at antenna electrode 42 into two branches of resonators, a transmitter branch 50 and a receiver branch 52. Transmitter branch 50 extends between antenna electrode 42 and end 26, while receiver branch 52 extends in the opposite direction between antenna electrode 42 and end 24. Each branch includes a plurality of resonators and a respective input/output electrode. More specifically, transmitter branch 50 includes a transmitter electrode 38, and receiver branch 52 includes a receiver electrode 40. Transmitter electrode 38 and receiver electrode 40 are spaced apart from antenna electrode in opposite directions along the length of core 12.

Transmitter branch 50 includes a trap resonator 54. Trap resonators, such as resonator 54, are configured to produce a zero, or attenuation pole, in the transfer function of the filter. To serve as a frequency trap, the resonator is located adjacent transmitter connection electrode 38 but opposite the array of spaced-apart resonators which extend between antenna electrode 42 and transmitter electrode 38. More specifically, trap resonator 54 is positioned between transmitter electrode 38 and end 26 of core 12. Likewise, receiver branch 52 includes a trap resonator 56 positioned between receive electrode 40 and end 24 of core 12.

Filters according to the present invention are optionally equipped with a metallic shield positioned across top surface 16. For a discussion of metal shield configurations, see U.S. Pat. No. 5,745,018 to Vangala.

Communication filters according to the present invention are prepared by etching the surfaces of a shaped and fired ceramic core, applying an electroless nickel solution to create a nickel layer of a thickness in the range of about 0.13 to about 0.64 microns ($\mu$m) (preferably 0.25 to about 0.3 microns ($\mu$m)), electroplating the nickel plated core with a silver layer, patterning the nickel and silver plated core by removing metallization from selected surface areas and then heating the patterned filter block to bond the metal layers.

An important component of the present invention is the rigid core of dielectric material. The core is preferably made of a ceramic material selected for mechanical strength, dielectric properties, plating compatibility, and cost. Preferred dielectric compositions have a dielectric constant in the range of about 25 to about 100 as measured using the Hakki-Coleman dielectric resonator method. For a description of the Hakki-Coleman test method see, B. W. Hakki and P. D. Coleman: *IRE Trans. Microwave Theory & Technology* Vol. 8, 1960, p. 402.

Titanate ceramic compositions are preferred for filter cores according to the invention. The term "titanate," as used here, refers to a ceramic composition including at least about 20 weight percent titanium based on the total weight of the composition. For improved electrical performance, a zirconia titanate material is specifically preferred and present at levels of at least about 10 weight percent zirconium (based on the total weight of the core composition) or 15 mole percent zirconium (based on the total core composition). The term "a zirconia titanate," as used herein, refers to a ceramic composition including at least 20 weight percent titanium and at least 10 weight percent zirconium, based on the total weight of the composition.

In general, preferred materials for the dielectric core can be selected from the group consisting essentially of a barium titanate, a tin zirconia titanate, barium neodymium titanate, and barium neodymium samarium titanate. The term "a barium titanate," as used herein, refers to a ceramic composition including at least 20 weight percent titanium and at least 10 weight percent barium, based on the total weight of the composition. The term "a tin zirconia titanate," as used herein, refers to a ceramic composition including at least 20 weight percent titanium, at least 10 weight percent zirconium and at least 10 weight percent tin, based on the total weight of the composition. The term "a barium neodymium titanate," as used herein, refers to a ceramic composition including at least 20 weight percent titanium, at least 10 weight percent neodymium and at least 10 weight percent barium, based on the total weight of the composition. The term "a barium neodymium samarium titanate," as used herein, refers to a ceramic composition including at least 20 weight percent titanium, at least 10 weight percent samarium, at least 10 weight percent neodymium, and at least 10 weight percent barium, based on the total weight of the composition.

The preparation steps for making suitable dielectric ceramics for the filter core are described in U.S. Pat. No. 6,107,227 to Jacquin et al. and U.S. Pat. No. 6,242,376, the disclosures of which are hereby incorporated by reference to the extent they are not inconsistent with the present teachings. The filter cores are preferably prepared by mixing separate constituents in particulate form (e.g., $Nd_2O_3$, $TiO_2$, $ZrO_2$) with heating steps followed by press molding and then a firing step to react and inter-bond the separate constituents and de-gas the core. The dimensions of the molded cores are adjusted as needed before or after the firing step.

The inner, nickel-based layer is placed onto the ceramic core by electroless deposition. For deposition of the nickel-based layer, the outer surfaces and through-hole sidewalls of the core are preferably prepared by cleaning and surface etching.

Batches of shaped ceramic cores are cleaned in multiple steps. First, the cores are soaked at an elevated temperature using a suitable cleaning solution such as an octylphenoxy-polyethanoxyethanol solution commercially available from Fidelity Chemical Products Corp. (Newark, N.J.) under the designation "3152 Alkaline Soak Cleaner."

After one or more optional deionized water rinses, the ceramic cores are next cleaned by soaking in an elevated temperature bath of a methane sulfonic acid. A suitable methane sulfonic acid solution is commercially available from LeaRonal, Inc. (Freehold, N.J.) under the designation "Solderon," and is diluted to about 70 volume percent Solderon with deionized water. The second cleaning solution step is followed by a water rinse step using deionized or distilled water.

The surface-etching step is carried out by physically abrading the surfaces (e.g. sanding) or by chemical treatment. Chemical methods are presently preferred for facilitating mass production, although physical abrasion may provide superior etching.

The description of a preferred acid etching subprocess follows. The cleaned cores are etched in an acid solution prepared from acid etchants capable of etching the particular ceramic material selected for the cores, i.e. a barium titanate, a zirconia titanate, or others as discussed hereinabove. For example, the acid etchant may be a phosphoric acid, a halogen acid, i.e. hydrofluoric acid, hydrochloric acid, hydrobromic acid, hydroiodic acid, and the like, or their combinations. In addition, other acid etchants which may be utilized include nitric acid, permanganic acid, fluoboric acid, or any other strong inorganic acid, as well as mixtures thereof. The preferred acid etchant is an aqueous hydrofluoric acid (HF)-phosphoric acid ($H_3PO_4$) solution. Preferred for acid etching cores of tin zirconia titanate is a solution of ammonium bifluoride with sulfuric acid.

The duration and degree of the acid etch desired depends upon the ceramic material selected for fabricating the cores.

After the acid etch, the ceramic cores are cooled to room temperature. The acid treated cores are next subjected to a number of cleaning and conditioning (or activating) steps employed in electroless deposition processes. The etched and rinsed cores are treated with an elevated-temperature ethanolamine solution bath. A suitable ethanolamine solution is commercially available from Fidelity Chemical Products Corp. under the designation "1012 Alkaline Cleaner."

The ceramic cores are again optionally rinsed with deionized water and next undergo multiple surface activator treatments as follows. The blocks are dipped and briefly held in a sodium bisulfate solution (source: Fidelity, designation—"1017 Activator Salt Solution"), rinsed with deionized water and then bathed in a hydrochloric acid—stannous chloride solution (source: Fidelity, designation—"1018 Activator"). The cores are again rinsed and then dipped and briefly held in a wetting agent such as fluorboric acid solution (source: Fidelity, designation—"1019 Acid Accelerator"). The wetting agent helps to maintain proper core coverage of the plating solutions. The fluorboric acid dip is similarly followed by a deionized water rinse step.

The cores also optionally undergo an activator treatment using a palladium chloride solution. Such a palladium chloride treatment is preferred for cores containing zirconia.

After performing the above cleaning and conditioning steps, the working surface of the ceramic substrate is ready for electroless deposition of metal. The ceramic blocks are submerged into a bath of electroless nickel plating solution for a duration sufficient to provide a nickel-based layer on the cores in the preferred thickness range of about 0.13 to about 0.64 microns ($\mu$m), and more preferably at most about 0.5 microns ($\mu$m). Electroless nickel-plated deposits may not be pure nickel but contain some amount of the reducing agent.

For a discussion of electroless nickel plating solutions, see, for example, Lowenheim, Frederick A., ed. *Modern Electroplating,* 3$^{rd}$ Ed., Wiley & Sons, N.Y. (1974), Chapter 31, pp. 712–713. A typical electroless nickel-plating solution relying on a phosphate reducing agent has the following makeup:

| | |
|---|---|
| $NiSO_4.6H_2O$ | 30 grams/liter |
| Sodium Citrate, $Na_3C_6H_5O_7.2H_2O$ | 100 grams/liter |
| $NH_4Cl$ | 50 grams/liter |
| $NaH_2PO_2.H_2O$ | 10 grams/liter |
| $NH_4OH$ | to a pH of about 10.5 |

The above plating solution yields a nickel layer containing about 2 to 5 weight percent phosphorus, based on the total weight of the nickel layer. Electroless nickel plating baths relying on dimethylamine borane (DMAB) are also suitable and yield substantially pure nickel coating.

Presently preferred is an electroless nickel-plating solution commercially available from Fidelity Chemical Products Corp. under the designation "9026 Electroless Nickel Plating Solution." Using a 9026 solution bath elevated to about 81° C., a core contact duration of about 30 to 45 seconds has been found to provide a nickel layer thickness of about 0.5 microns (μm).

The outer, silver layer of the conductive coating is next electrolytically deposited on the nickel-plated cores. Silver electroplating baths of differing chemistries and configurations are suitable. A barrel electroplater configuration has been used. In general, brightener-free electroplating baths are preferred because brighteners are thought to overdensify the silver layer and lead to blistering during the firing step.

Both the duration and speed of silver electroplating are important variables for making blocks according to the present invention. The speed of silver deposition in the electroplating process is directly affected by the current density applied. The filter cores are preferably electroplated to achieve a silver layer thickness in the range of about 7.5 to about 25.4 microns. Within this range a thinner silver layer is preferred for cost savings and to reduce the risk of firing-step blistering, whereas a thicker silver layer is preferred for enhanced filter electrical performance.

Filters according to the present invention having a silver-containing layer thickness in the range of about 7.5 to about 25.4 microns exhibited a pull strength of about 80 Newtons (N). Notably, even filters with silver-containing layer thickness of about 10 microns exhibit a pull strength of about 80 Newtons (N).

To reducing the risk of core blistering during a later firing step, the cores are preferably electroplated with silver at a relatively high current density of about 270 amperes per square centimeter. A higher current density is thought to create a more porous, and therefore, less blister-prone, silver layer.

To provide both a relatively porous layer and improved silver coverage over the sidewalls of the core through-holes, the silver-containing layer is electrolytically deposited for a period at a relatively low current density and for another period at a relatively high current density. Alternating short duration periods of low current and high current density are preferred. The periods of relatively lower, e.g. about 54 amperes per square centimeter, are thought to increase coverage over the core through-hole side walls, while the periods of relatively high current density, e.g. about 270 amps per square centimeter, are thought to create a more porous, firing-compatible layer.

The silver plated filter cores are rinsed with water and optionally acetone and then air dried before further processing. The resulting cores are fully plated (or coated) over their outer surfaces and through-holes sidewalls.

The plated cores are next processed with a computer-controlled scanning laser to ablatively remove metallization from selected regions (or areas). The scanning laser system removes specified regions of metallization to create a pattern of metallized and unmetallized areas on the core, such as pattern 14 as discussed in reference to FIGS. 1 and 2, above.

This laser ablation approach results in unmetallized areas that are not only free of metallization, but also recessed into the surfaces of core because laser ablation removes both the silver on nickel metal layer and a slight portion of the dielectric material of the core. Results have been achieved using an Nd:YAG laser operating for a wavelength of about 1064 nanometers. Suitable laser systems are commercially available from Lee Laser (Orlando, Fla.) under the designation "Series 600." The pulse frequency and beam speed are adjusted to provide unmetallized areas recessed into the core to a depth in the range of about 30 microns (μm) to about 7 microns (μm). The recess preferably does not exceed a maximum depth of about 20 microns (μm).

As an alternative to laser pattern ablation, selected surfaces of the fully metallized core are removed by abrasive forces such as particle blasting resulting in one or more unmetallized surfaces. The pattern of metallized and unmetallized areas is then completed by pattern printing with thick film metallic paste.

The patterned blocks are next heated, i.e. fired, in a furnace to a high temperature in the range of about 800° C. to about 950° C., preferably 840° C. The firing step is thought to improve the dielectric properties of the core and improve both the conductive properties and the adhesion of the silver on nickel layers. In one set of example filters, a 230 percent increase in pull strength was observed as a result of the firing step.

After the firing step, a diffused interface has been formed between the silver-containing layer and the nickel layer which is substantially coextensive with the coverage of the nickel layer of the dielectric core. Filters according to the present invention feature a silver layer of a more uniform thickness. Specifically, for filters according to the present invention, the ratio of the maximum thickness to minimum thickness of the silver-containing layer over the surface of the filter does not exceed about 4 to 1.

EXAMPLE

A batch of filters was prepared according to the design of FIGS. 1 and 2. Shaped (with through-holes) and fired cores of a barium neodymium samarium titanate ceramic were cleaned and activated as follows: The cores were placed in a plastic mesh basket and dipped into a bath of 3152 alkaline non-silicated soak cleaner solution (from Fidelity Chemical Products Corp.). The bath temperature was controlled to about 65° C. to 70° C. and the cores were submerged for about ten minutes.

The cores were next rinsed twice in deionized water before being next set for about five minutes in a solution of methane sulfonic acid ("Solderon," LeaRonal, Inc.) maintained at about 60° C. The cores are again rinsed in deionized water.

The cleaned cores were then treated in an aqueous hydrofluoric acid (HF)-phosphoric acid ($H_3PO_4$) solution for about 30 minutes. The acid treated cores were rinsed with deionized water and then soaked in 1021 alkaline cleaner (from Fidelity Chemical Products Corp.) elevated to about 55° C. for about 20 minutes and followed by another cycle of deionized water rinse.

The cores were next dipped into 1017 activator salts (from Fidelity) for about one minute, rinsed again with deionized water, dipped into another activator solution, 1018 activator (from Fidelity), for six minutes, and rinsed again with deionized water.

The cores were next dipped into 1019 acid accelerator (from Fidelity) for about two minutes at room temperature and re-rinsed in deionized water.

The cores were next introduced into a bath of 9026 electroless nickel plating (from Fidelity) heated to 81° C. The cores were kept in contact with the 9026 solution for about 30 to 45 seconds, resulting in a plated thickness of approximately 0.5 microns (μm). The nickel-coated cores were rinsed with deionized water. The ceramic blocks were placed in a barrel basket with plating media.

The nickel-coated cores were next electrolytically coated with silver as follows: The cores were loaded into an electroplating barrel basket together with plating media, and the barrel was set to rotate at about 7 to 10 revolutions per minute. The loaded barrel was rinsed for five to ten seconds with deionized water. The negative pole was connected and activated with a slight current before submerging the barrel into a 1025 silver plating bath (from Technics Corporation).

The current density was first set to about 54 amperes per square centimeter for one minute and thereafter switched to about 270 amperes per square centimeter. The cycle of high and low current density was then repeated to achieve a silver-plating thickness of about 7.6 to about 10 microns (μm).

The barrel was next dipped multiple times into deionized water for rinsing. To aid drying, the plated blocks were rinsed in acetone.

The plated cores were next patterned using a scanning laser system to achieve a pattern of metallized and unmetallized areas as shown in FIGS. 1 and 2. The patterned cores were next fired to a maximum temperature of about 840° C. for ten minutes.

Specific design parameters for the communication filters of the example batch are provided in Table I, below.

TABLE I

| | |
|---|---|
| Filter length (side 24 to side 26) | 21.3 mm |
| Filter board height (side 20 to 22) | 4 mm |
| Filter width (side 16 to side 18) | 9 mm |
| Core dielectric constant | 87 |
| Outgoing (transmit) signal passband | 824 to 849 MHz |
| Incoming (receive) signal passband | 869 to 894 MHz |

Figure 3A:
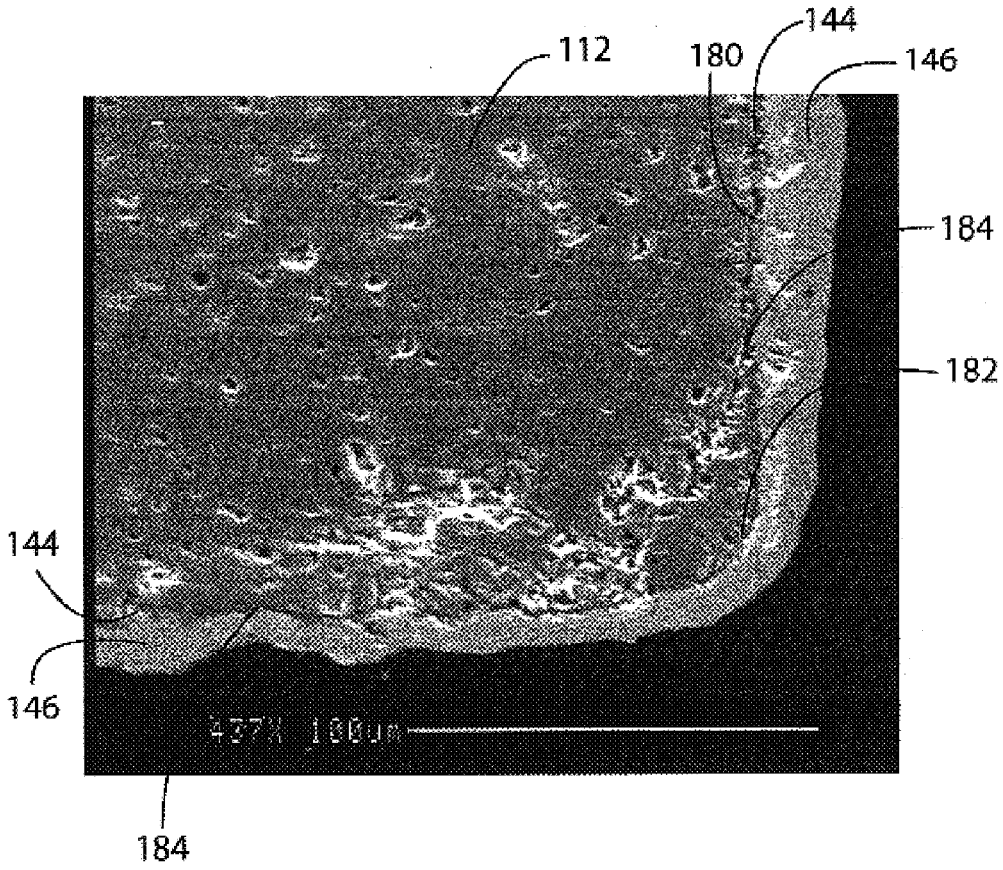
FIG. 3A is a photomicrograph of a section of a filter according to the invention showing the plating layers at a corner defined at a through-hole opening.

The resulting plating on the example filters was evaluated by taking a photomicrograph of selected sections. FIG. 3A is a section of an example filter revealing the plating layers at a corner defined at a through-hole opening. The corners defined by the opening of through-holes are a known trouble for obtaining sufficient metal layer coverage when using a dipping process. In FIG. 3A, the dielectric core is identified by reference number 112. The through-hole inner wall is identified with reference number 180 and the corner with reference numeral 182.

On core 112 is a nickel layer 144 and a silver layer 146. The nickel layer 144 together with core 112 forms a heterogeneous interface 184. As indicated in FIG. 3A, the thickness of silver layer 146 at corner 182 is about 11 microns (μm).

Figure 3B:
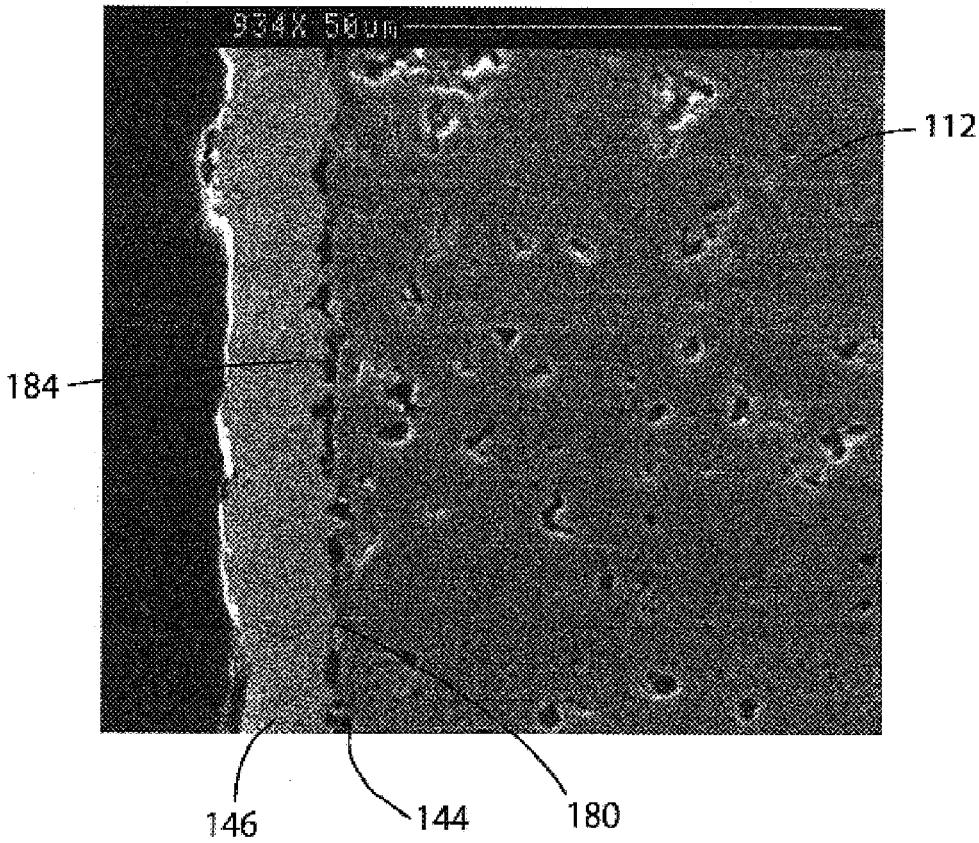
FIG. 3B is a photomicrograph of a section of a filter according to the invention showing the plating layers at a sidewall within a through-hole.

FIG. 3B is a photomicrograph of a section of an example filter showing the plating layers at a sidewall within a through-hole. The sidewalls at inner portions of through-holes are a known trouble spot for obtaining uniform metal coverage when using a dipping process. As FIG. 3B reveals, dielectric core 112 and nickel layer 144 form a diffused interface 184. The thickness of silver layer 146 on through-hole wall 180 is in the range of about 11 to about 12 microns (μm).

Figure 4:
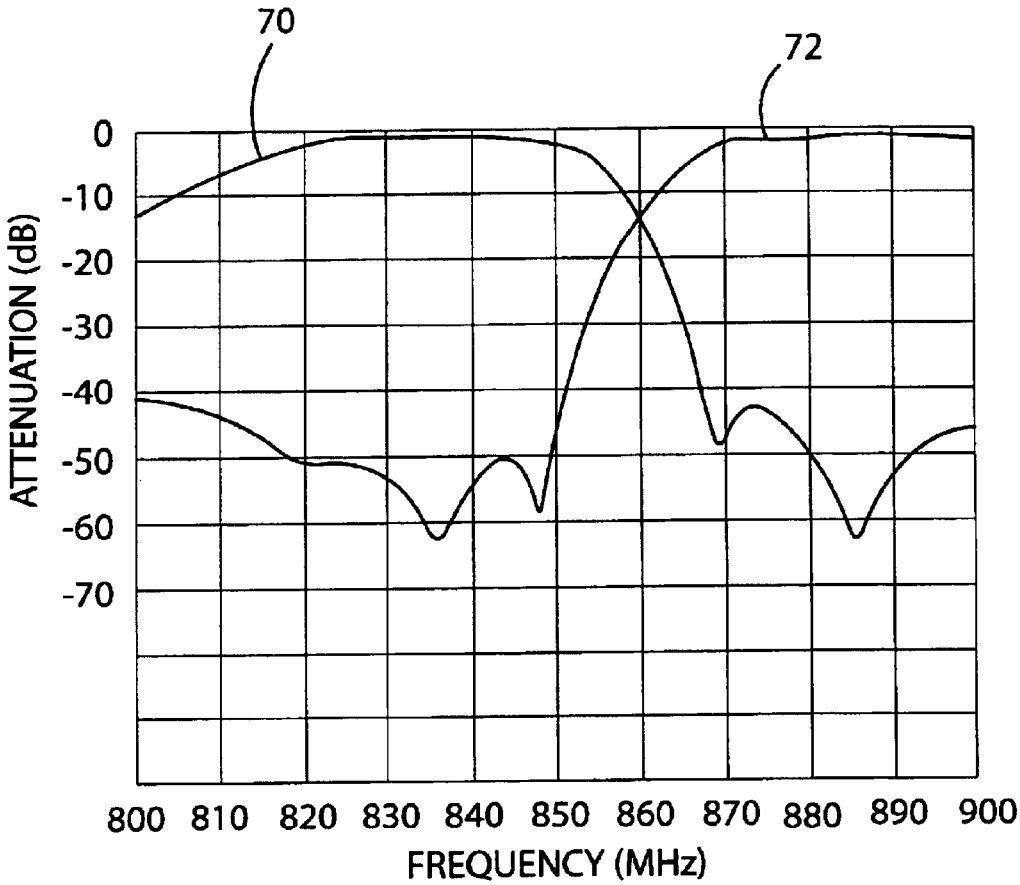
FIG. 4 is a frequency response graph (S21) for a filter according to FIG. 1.

The example filters were also evaluated by measuring the type 21 Scattering Parameter using a network analyzer. FIG. 4 is a resulting response graph for the example filters. FIG. 4 includes a plot identified with reference numeral 70 for a signal passing between transmit contact 38 and antenna contact 42, and a plot identified with reference numeral 2 for a signal passing between antenna contact 42 and receive contact 40.

More specifically, FIG. 4 is a graph of type 21 Scattering Parameters (S21). Scattering Parameters were defined and related testing methods were developed to address the complexity of measuring and comparing electric devices for high frequency applications. S-parameters are ratios of reflected and transmitted traveling waves measured at specified component connection points. An $S_{21}$ data point or plot is a measure of insertion loss, a ratio of an output signal at an output connection to an input signal at an input connection, at one or a range of input signal frequencies.

For a discussion of Scattering Parameters and associated test standards and equipment, please consult the following references: Anderson, Richard W., "S-Parameter Techniques for Faster, More Accurate Network Design," *Hewlett-Packard Journal*, vol. 18, no. 6, February 1967; Weinert, "Scattering Parameters Speed Design of High Frequency Transistor Circuits," *Electronics*, vol. 39, no. 18, Sep. 5, 1986; or Bodway, "Twoport Power Flow Analysis Using Generalized Scattering Parameters," *Microwave Journal*, vol. 10, no. 6, May 1967.

As revealed by FIG. 4, the fabricated example filters exhibited a transmit passband of 824 to 849 MHz and a receive passband of 869 to 894. The fabricated example filters exhibited a maximum transmit passband insertion loss in the range of about 1.5 to about 3.0 decibels (dB) and a maximum receive passband insertion loss in the range of about 2.5 to about 4.2 decibels (dB).

The example filters were also tested for pull strength (or bond strength) to assess the adhesion-quality of the fabrication process. A nail head wire termination of about 1.3 millimeters was soldered to the I/O side of the filter using a 62/36/2 Sn/Pb/Ag solder paste (approximately 1.0 micro liter). The pull force required to break the connection was measured. The example filters exhibited a pull strength of about 80 Newtons (N).

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

We claim:

1. A communication signal filter comprising:

a rigid dielectric core having at least one pair of opposing sides and defining a plurality of through-hole passages extending between the opposing sides, a pattern of metallized and unmetallized regions on the core, the metallized regions including an inner layer of nickel and an outer silver-containing layer on the inner layer, wherein the nickel layer and the dielectric core form a diffused interface therebetween substantially coextensive with the nickel layer.

2. The filter according to claim 1 wherein the silver-containing layer has a thickness in the range of about 7.5 to about 25.4 microns (μm).

3. The filter according to claim 1 wherein the silver-containing layer has a thickness in the range of about 7.5 to about 25.4 microns (μm) and the filter exhibits a pull strength of at least 80 Newtons (N).

4. The filter according to claim 1 wherein the silver-containing layer has a thickness of at most about 10.0 microns (μm) and the filter exhibits a pull strength of at least 80 Newtons.

5. The filter according to claim 1 wherein the ratio of the maximum thickness to minimum thickness of the silver-containing layer does not exceed about 4 to 1.

6. The filter according to claim 1 wherein the dielectric core is a zirconia titanate.

7. The filter according to claim 1 wherein the dielectric core is a titanate material.

8. The filter according to claim 7 wherein the dielectric core is made of a material selected from the group consisting essentially of a barium titanate, a tin zirconia titanate, a barium neodymium titanate, and a barium neodymium samarium titanate.

9. The filter according to claim 1 wherein the dielectric core contains zirconium.

10. The filter according to claim 1 wherein the dielectric core contains at least about 10 weight percent zirconium based on the total weight of the core composition.

11. The filter according to claim 1 wherein the dielectric core contains at least about 15 mole percent zirconium based on the total core composition.

12. A passband filter according to claim 1.

13. A filter according to claim 1 characterized in that the filter is a duplexer.

14. A duplexing filter according to claim 1 wherein the pattern of metallized and unmetallized regions includes a transmitter surface mount connection metallized region, a receiver surface mount connection, metallized region, and an antenna surface mount metallized region.

15. The filter according to claim 1 wherein the through-hole passages terminate in opposing openings on the opposing sides and the pattern of metallized and unmetallized regions includes an expansive area of metallization and a contiguous unmetallized area circumscribing at least one of the openings.

16. The filter according to claim 1 wherein the pattern of metallized and unmetallized regions includes an unmetallized region recessed into the core.

17. The filter according to claim 1 wherein the pattern of metallized and unmetallized regions includes an unmetallized region recessed into the core to a depth in the range of about 7 to about 30 microns (μm).

18. A passband filter according to claim 1 exhibiting a passband selected from the group consisting essentially of 804 to 824 MHz, 824 to 849 MHz, 850 to 870 MHz, 869 to 894 MHz, 1226 to 1228 MHz, 1525 to 1559 MHz, 1574 to 1576 MHz, 1626.5 to 1660.5 MHz, 1750 to 1780 MHz, 1840 to 1870 MHz, 1850 to 1910 MHz, 1920 to 1980 MHz, 1930 to 1990 MHz, 2110 to 2170 MHz.

19. The filter according to claim 1 wherein the nickel layer contains about 90 weight percent nickel based on the weight of the nickel layer.

20. The filter according to claim 1 wherein the silver containing layer contains about 90 weight percent silver based on the weight of the silver-containing layer.

21. The filter according to claim 1 wherein the silver-containing layer contains about 5 weight percent non-metallic material based on the weight of the silver layer.

22. The filter according to claim 1 wherein the core has a substantially rectangular parallelepiped shape.

23. The filter according to claim 1 wherein the core defines two through-hole passageways.

24. A communication signal filter comprising:

a rigid dielectric core having at least one pair of opposing sides and defining a plurality of through-hole passages extending between the opposing sides, a pattern of metallized and unmetallized regions on the core, the metallized regions including an inner layer of nickel and an outer silver-containing layer on the inner layer wherein the nickel layer contains phosphorus in the range of about 2 to about 5 percent based on the weight of the nickel layer.

25. A duplexing communication signal filter adapted for connection to an antenna, a transmitter and a receiver for filtering an incoming signal from the antenna to the receiver and for filtering an outgoing signal from the transmitter to the antenna, the filter comprising:

a rigid core of dielectric material with a top surface and a bottom surface, the core defining a series of through-holes, each through-hole extending from an opening on the top surface to an opening on the bottom surface; and a surface-layer pattern of metallized and unmetallized areas on the core, the pattern including, an expansive metallized area;

an unmetallized area circumscribing at least one of the openings;

a transmitter connection metallized area;

a receiver connection metallized area;

an antenna connection metallized area positioned between the transmitter connection metallized area and the receiver connection metallized area, wherein each of the metallized areas includes a first layer of nickel and a second silver-containing layer on the first layer and wherein the nickel layer and the core form a diffused interface therebetween substantially coextensive with the nickel layer.

26. The filter according to claim 25 wherein the silver-containing layer has a thickness in the range of about 7.5 to about 25.4 microns (μm).

27. The filter according to claim 25 wherein the silver-containing layer has a thickness of at most about 10 microns (μm) and the filter exhibits a pull strength of at least 90 Newtons (N).

28. The filter according to claim 25 wherein the ratio of the maximum thickness to minimum thickness of the silver-containing layer does not exceed about 4 to 1.

29. The filter according to claim 25 wherein the dielectric core is a zirconia titanate.

30. The filter according to claim 25 wherein the dielectric core is a titanate material.

31. The filter according to claim 30 wherein the dielectric core is made of a material selected from the group consisting essentially of a barium titanate, a tin zirconia titanate, a barium neodymium titanate, and a barium neodymium samarium titanate.

32. The filter according to claim 25 wherein the dielectric core contains zirconium.

33. The filter according to claim 25 wherein the dielectric core contains at least about 10 weight percent zirconium based on the total weight of the core composition.

34. The filter according to claim 25 wherein the dielectric core contains at least about 15 mole percent zirconium based on the total core composition.

35. The filter according to claim 25 exhibiting a transmit signal passband selected from the group consisting essentially of 804 to 824 MHz, 824 to 849 MHz, 850 to 870 MHz, 869 to 894 MHz, 1226 to 1228 MHz, 1525 to 1559 MHz, 1574 to 1576 MHz, 1626.5 to 1660.5 MHz, 1750 to 1780 MHz, 1840 to 1870 MHz, 1850 to 1910 MHz, 1920 to 1980 MHz, 1930 to 1990 MHz, 2110 to 2170 MHz.

36. The filter according to claim 25 exhibiting a receive signal passband selected from the group consisting essentially of 804 to 824 MHz, 824 to 849 MHz, 850 to 870 MHz, 869 to 894 MHz, 1226 to 1228 MHz, 1525 to 1559 MHz, 1574 to 1576 MHz, 1626.5 to 1660.5 MHz, 1750 to 1780 MHz, 1840 to 1870 MHz, 1850 to 1910 MHz, 1920 to 1980 MHz, 1930 to 1990 MHz, 2110 to 2170 MHz.

37. The filter according to claim 25 wherein the core has a substantially rectangular parallelepiped shape.

38. A duplexing communication signal filter adapted for connection to an antenna, a transmitter and a receiver for filtering an incoming signal from the antenna to the receiver and for filtering an outgoing signal from the transmitter to the antenna, the filter comprising:

a rigid core of dielectric material with a top surface and a bottom surface, the core defining a series of through-holes, each through-hole extending from an opening on the top surface to an opening on the bottom surface; and a surface-layer pattern of metallized and unmetallized areas on the core, the pattern including, an expansive metallized area;

a unmetallized area circumscribing at least one of the openings;

a transmitter connection metallized area, a receiver connection metallized area, an antenna connection metallized area positioned between the transmitter connection metallized area and the receiver connection metallized area, wherein each of the metallized areas includes a first layer of nickel and a second silver-containing layer on the first layer and wherein the nickel layer contains phosphorus in the range of about 2 to about 5 percent based on the weight of the nickel layer.

* * * * *